US012746433B2

(12) United States Patent
Oh et al.

(10) Patent No.: US 12,746,433 B2
(45) Date of Patent: Sep. 29, 2026

(54) DEVICE FOR SENSING GOLF SWING AND METHOD FOR SENSING IMPACT POSITION ON CLUB HEAD USING THE SAME

(71) Applicant: GOLFZON CO., LTD., Seoul (KR)

(72) Inventors: Kun Su Oh, Seoul (KR); Jae Sun Lee, Guri-si (KR)

(73) Assignee: GOLFZON CO., LTD., Seoul (KR)

( * ) Notice: Subject to any disclaimer, the term of this patent is extended or adjusted under 35 U.S.C. 154(b) by 303 days.

(21) Appl. No.: 18/026,124

(22) PCT Filed: Sep. 13, 2021

(86) PCT No.: PCT/KR2021/012412
§ 371 (c)(1),
(2) Date: Mar. 14, 2023

(87) PCT Pub. No.: WO2022/055318
PCT Pub. Date: Mar. 17, 2022

(65) Prior Publication Data

US 2023/0347209 A1 Nov. 2, 2023

(30) Foreign Application Priority Data

Sep. 14, 2020 (KR) ..... 10-2020-0117586

(51) Int. Cl.
*A63B 24/00* (2006.01)
*A63B 71/06* (2006.01)
*A63B 69/36* (2006.01)

(52) U.S. Cl.
CPC ..... *A63B 24/0006* (2013.01); *A63B 24/0021* (2013.01); *A63B 71/0622* (2013.01);
(Continued)

(58) Field of Classification Search
CPC ..... A63B 24/0006; A63B 24/0021; A63B 71/0622; A63B 69/3623; A63B 2024/004;
(Continued)

(56) References Cited

U.S. PATENT DOCUMENTS 9,514,379 B2 * 12/2016 Park ..... G09B 19/0038
2005/0213076 A1 * 9/2005 Saegusa ..... G01P 3/40 356/28

(Continued)

FOREIGN PATENT DOCUMENTS

JP 2012-095789 A 5/2012
JP 2013-240486 A 12/2013

(Continued)

OTHER PUBLICATIONS

International Search Report for PCT/KR2021/012412 mailed Dec. 22, 2021 from Korean Intellectual Property Office.

*Primary Examiner* — Michael C Grant
(74) *Attorney, Agent, or Firm* — Revolution IP, PLLC

(57) ABSTRACT

The present invention is to provide a device for sensing golf swing and a method for sensing an impact position on club head using two cameras operated in a stereoscopic manner with each other in the sensing device to accurately calculate the position where the golf ball is impacted on the head-face of the golf club when hitting the golf ball.

6 Claims, 10 Drawing Sheets

(52) U.S. Cl.
CPC . *A63B 2024/004* (2013.01); *A63B 2024/0043* (2013.01); *A63B 69/3623* (2013.01); *A63B 2220/05* (2013.01); *A63B 2220/807* (2013.01)

(58) Field of Classification Search
CPC ..... A63B 2024/0043; A63B 2220/05; A63B 2220/807; A63B 60/46; A63B 69/36; A63B 2024/0028; A63B 2220/806; G06T 2207/30224; G06T 2207/30241; G06T 7/285; G01B 11/00; G01B 11/002
USPC ..... 473/131
See application file for complete search history.

(56) References Cited

U.S. PATENT DOCUMENTS

2007/0202959 A1* 8/2007 Rankin ..... A63B 24/0021 473/151
2009/0270204 A1* 10/2009 Saegusa ..... A63B 69/3614 473/409
2012/0108354 A1* 5/2012 Kamino ..... A63B 24/0003 473/221
2012/0157241 A1* 6/2012 Nomura ..... A63B 69/3632 473/422
2012/0214606 A1* 8/2012 Ueda ..... A63B 69/3614 473/409
2013/0190098 A1* 7/2013 Kiraly ..... G06T 7/248 473/409
2013/0305806 A1* 11/2013 Saito ..... G06T 7/246 73/11.01
2014/0004967 A1* 1/2014 Jang ..... G09B 9/00 473/409
2014/0004969 A1* 1/2014 Jang ..... G06T 7/248 473/409
2014/0185867 A1* 7/2014 Ishikawa ..... G06V 40/23 382/103
2015/0119159 A1* 4/2015 Sato ..... G06V 40/23 473/409
2018/0136306 A1* 5/2018 Kim ..... A63B 69/3658
2018/0290041 A1* 10/2018 Vollbrecht ..... G09B 19/0038
2019/0255413 A1* 8/2019 Oh ..... G06T 7/70
2020/0038742 A1* 2/2020 Van Wagoner .... A63B 69/3658
2021/0223032 A1* 7/2021 Suk ..... G06T 7/246
2022/0072370 A1* 3/2022 Kim ..... G06V 20/647
2022/0233939 A1* 7/2022 Oh ..... G06T 7/246
2023/0066820 A1* 3/2023 Shaw ..... A63B 53/047

FOREIGN PATENT DOCUMENTS

KR 10-2013-0013403 A 2/2013
KR 10-2013-0077795 A 7/2013
KR 10-2017-0040814 A 4/2017
KR 10-2018-0087748 A 8/2018
KR 10-2019-0122369 A 10/2019
KR 10-2019-0129971 A 11/2019

* cited by examiner (a)

(b)

(a)

(b)

(a)

(b)

(a)

(b)

(a)

(b)

DEVICE FOR SENSING GOLF SWING AND METHOD FOR SENSING IMPACT POSITION ON CLUB HEAD USING THE SAME

TECHNICAL FIELD

The present invention is related to a sensing device for sensing golf swing and a method for sensing impact position on a club head using the sensing device that when a user hits a golf ball by holding a golf club, the image of the golf club and the golf ball is acquired and analyzed to calculate sensing data on the golf ball and the movement of the golf club and the sensing data is transmitted to an analyzer, and the information on the trajectory of the golf ball and the golf shot information by the golf club are analyzed in the analyzer of the golf practice system or screen golf system and provided to the user.

BACKGROUND ART

The technology for analyzing images of exercising objects and calculating the location information of the objects is used as a sensing device in various simulators and devices in the form of interactive sports simulation that allow popular sports games such as baseball, soccer, basketball, and golf to be enjoyed indoors or in a specific place.

For example, when a user hits a golf ball with a golf club, the position of the moving golf club and the golf ball is calculated for each frame taken, and various kinetic information such as the trajectory, speed, direction, and height of the golf ball and the golf club can be calculated using the calculated positions information, and analytic information on a user's golf swing can be calculated using the information, or a simulation image of a golf ball flying through an image in a virtual golf simulation system such as screen golf can be implemented.

In general, golfers who enjoy golf are most interested in whether the golf ball hit the sweet spot on the head-face or where the golf ball hit the head-face when hitting the golf ball by the golf swing while practicing the golf swing.

When hitting a golf ball with a golf club, for accurately detecting where the golf ball is impacted on the head-face of the golf club, it can be considered that a camera sensor is installed in the direction in which the head of the golf club faces during the golf swing, that is, the direction in which the golf ball flies by the impact, and the image on the impact is captured and analyzed to monitor where the golf ball is impacted on the head-face.

However, the above-mentioned method is difficult to adopt in reality in that there is too high a risk of sensor damage by a golf club or a golf ball. In addition, since the head of the golf club differs from the position of the golf ball from the camera's perspective, the size of the golf ball appears much larger than the actual size on the image, making it difficult to calculate the exact impact position.

Accordingly, most commonly used sensing devices, such as a sensing device used to a virtual golf simulation system or a launch monitor that senses a golf ball and a golf club during a golf swing, and a radar sensor for accurate analysis of a ball, cannot directly sense the location where the golf ball hits the head-face of the golf club on an impact.

Most of the above sensing devices for golf swings have a problem of difficulty in calculating accurate information on an impact position which is a position of the golf ball on the head-face when hitting the golf ball because they only predict the impact position when hitting golf ball using data such as the trajectory of the head of the golf club, the direction of the hit golf ball flying, and the type of the flying golf ball.

PRIOR ART DOCUMENTS

Korean Patent Application No. 10-2012-0155233
Korean Patent Application No. 10-2019-7030847
Korean Patent Application No. 10-2011-0075029

DISCLOSURE

Technical Problem

It is an object of the present invention to provide a device for sensing golf swing and a method for sensing an impact position on club head using two cameras operated in a stereoscopic manner with each other in the sensing device to accurately calculate the position where the golf ball is impacted on the head-face of the golf club when hitting the golf ball.

Technical Solution

In accordance with an aspect of the present invention, the above and other objects can be accomplished by the provision of a sensing device for a golf swing by which a golf club hits a golf ball, comprising: a first and a second cameras each of which acquires at different locations in a field of view including the golf ball and the golf club and operated in a stereoscopic manner; and a sensing processor configured for analyzing the image acquired by the first camera to calculate information on a first position from a club trajectory on the image acquired by the first camera, and analyzing the image acquired by the second camera to calculate information on a second position from a club trajectory on the image acquired by the second camera, wherein the sensing processor calculates an impact position where the club head hits the golf ball during the golf swing using the first position and the second position.

Preferably, the sensing processor includes an image processor configured for analyzing a first image which is an image acquired by the first camera to find a position of a first ball which is a portion of a golf ball on the first image, analyzing movement of the golf club on the first image to calculate a first club trajectory which is a trajectory of the golf club on the first image, analyzing a second image which is an image acquired by the second camera to find a position of a second ball which is a portion of a golf ball on the second image, and analyzing movement of the golf club on the second image to calculate a second club trajectory which is a trajectory of the golf club on the second image; and a position calculator configured for calculating the first position information using the position of the first ball and the first club trajectory, calculating the second position information using the position of the second ball and the second club trajectory, and calculating an impact position specified by the first position and the second position.

Preferably, the position calculator is configured for calculating a vertical distance from the center point of the first ball to the first club trajectory on the first image as a first ball distance, and calculating a vertical distance from the center point of the second ball to the second club trajectory on the second image as a second ball distance, wherein the position calculator calculates an impact position specified by the first position at the first ball distance from a reference position on the club face and the second position at the second ball distance from the reference position on the club face.

Preferably, the image processor is configured for calculating a trajectory in which a point where a toe-side end of the club head detected on the first image meets an optical axis of the first camera moves as the first club trajectory, and calculating a trajectory in which a point where a toe-side end of the club head detected on the second image meets an optical axis of the second camera moves as the second club trajectory.

Preferably, the position calculator is configured for calculating a vertical distance from the center point of the first ball to the first club trajectory on the first image as a first ball distance and a vertical distance from the center point of the second ball to the second club trajectory on the second image as a second ball distance, wherein the position calculator calculates a point where the first position at the first ball distance in the direction perpendicular to the optical axis of the first camera in contact with the toe side end of the club face and the second position at the second ball distance in the direction perpendicular to the optical axis of the second camera in contact with the toe side end of the club face meet each other as the impact position.

Preferably, the image processor is configured for calculating a trajectory in which a point corresponding to a hosel of the golf club detected on the first image moves as the first club trajectory, and calculating a trajectory in which a point corresponding to the hosel of the golf club detected on the second image moves as the second club trajectory.

Preferably, the position calculator is configured for calculating a vertical distance from the center point of the first ball to the first club trajectory on the first image as a first ball distance, and calculating a vertical distance from the center point of the second ball to the second club trajectory as a second ball distance, wherein the position calculator calculates a point where the first position at the first ball distance in the direction perpendicular to the optical axis of the first camera passing through the hosel position of the club face and the second position at the second ball distance in the direction perpendicular to the optical axis of the second camera passing through the hosel position of the club face meet each other as the impact position.

In accordance with another aspect of the present invention, there is provided a method for sensing an impact position on club head of a golf club using a sensing device including a first and a second cameras each of which acquires at different locations in a field of view including the golf ball and the golf club and operated in a stereoscopic manner for sensing a golf swing by which the golf club hits a golf ball, the method comprising: calculating a first position from a club trajectory on an image by analyzing the image acquired by the first camera; calculating a second position from a club trajectory on an image by analyzing the image acquired by the second camera; and calculating an impact position where the club head hits the golf ball during the golf swing using the first position and the second position.

Preferably, the calculating the first position includes: analyzing a first image which is the image acquired by the first camera to detect a first ball which is a portion of the golf ball in the first image; analyzing movement of the golf club on the first image to calculate a first club trajectory which is the trajectory of the golf club on the first image; calculating the first position using the position of the first ball and the first club trajectory, and wherein the calculating the second position includes: analyzing a second image which is the image acquired by the second camera to detect a second ball which is a portion of the golf ball in the second image; analyzing movement of the golf club on the second image to calculate a second club trajectory which is the trajectory of the golf club on the second image; and calculating the second position using the position of the second ball and the second club trajectory.

Preferably, the calculating the first position using the position of the first ball and the first club trajectory includes calculating a vertical distance from the center point of the first ball to the first club trajectory on the first image as a first ball distance, and calculating the first position at the first ball distance in the direction perpendicular to the optical axis of the first camera in contact with the toe side end of the club face, wherein the calculating the second position using the position of the second ball and the second club trajectory includes calculating a vertical distance from the center point of the second ball to the second club trajectory on the second image as a second ball distance, and calculating the second position at the second ball distance in the direction perpendicular to the optical axis of the second camera in contact with the toe side end of the club face, and wherein the method includes calculating a point where the first position and the second position meet each other as the impact position.

Advantageous Effects

The device for sensing golf swing and a method for sensing an impact position on club head using the same according to the present invention has an advantageous effect that it is possible to accurately calculate the position where the golf ball is impacted on the head-face of the golf club when hitting the golf ball using two cameras operated in a stereoscopic manner with each other in the sensing device.

BEST MODE

A device for sensing golf swing and a method for sensing an impact position on club head using the same according to the present invention will be more specifically described with reference to the drawings.

First, an example of a screen golf system in which a virtual golf simulation apparatus to which the sensing device according to an embodiment of the present invention is applied is installed will be described with reference to FIGS. 1 and 2.

Figure 1:
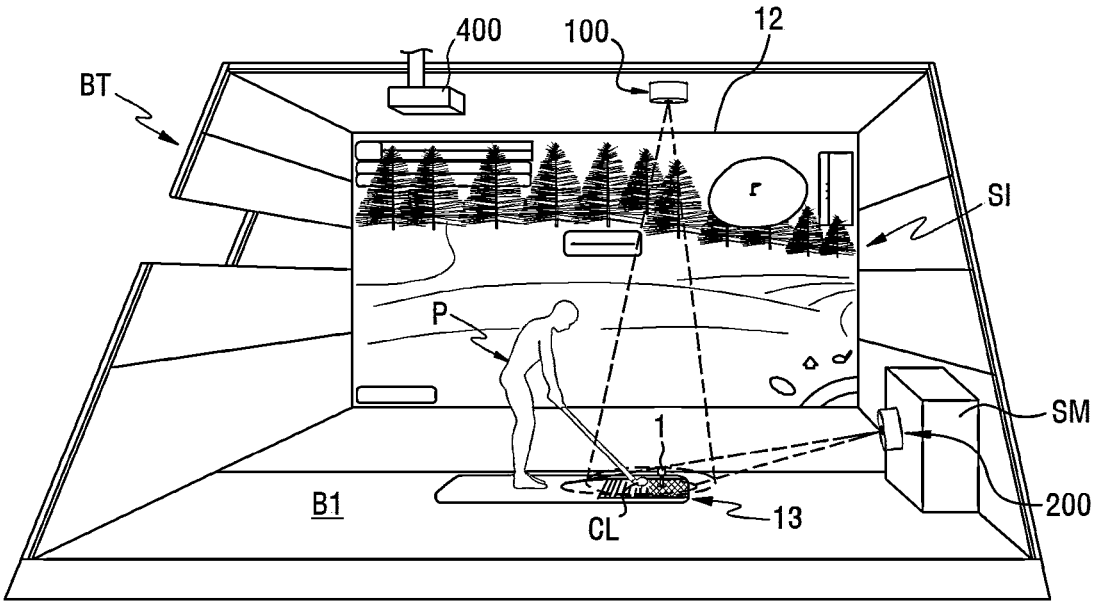
FIG. 1 shows a screen golf system including the sensing device according to an embodiment of the present invention.
Figure 2:
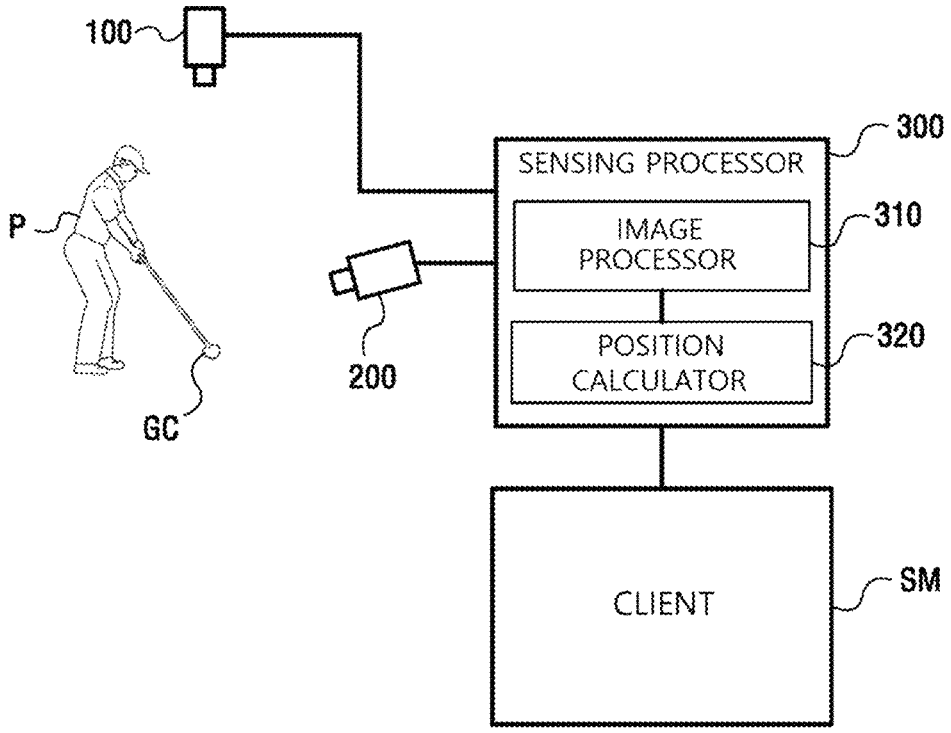
FIG. 2 is a block diagram showing a configuration of the sensing device shown in FIG. 1.

FIG. 1 shows a screen golf system including the sensing device according to an embodiment of the present invention, and FIG. 2 is a block diagram showing As shown in FIG. 1, in the booth BT forming a space for screen golf, a screen 12 may be installed in front of the user P, and the image output device 400 may receive image information from the client SM and output an image SI for the golf course to the screen 12.

A golf swing stage may be provided on the floor of the booth B1 and a golf mat 13 may be provided on the golf swing stage so that a golf ball 1 is placed on the golf mat and a golf swing by the golf club CL can be made on the golf swing stage. A client may be installed on one wall of the booth BT.

The sensing device according to an embodiment of the present invention includes a first camera 100 and a second camera 200. The first camera 100 and the second camera 200 are linked in a stereoscopic manner and installed at different positions, and each angle of view overlaps each other. For the same subject on the image of the first camera (100) and the image of the second camera, coordinate information on the three-dimensional space can be obtained using the coordinates on the first camera image and the coordinates on the second camera image.

As described above, it is desirable that the two cameras operated in the stereoscopic manner are installed at different positions and configured to have a viewing angle region overlapping each other. For example, as shown in FIG. 1, the first camera 100 may be installed on the ceiling of the booth BT, that is, above the user P's head to acquire an image of an area including the hitting mat 13 and the second camera 200 may be installed on the wall side of the booth (e.g., the client SM) to acquire an image of a side view.

The first camera 100 may be installed at an upper position of the user's head, i.e., a ceiling, the second camera 200 may be installed at a side position of the user, i.e., a wall side of the booth, and the first camera 100 and the second camera 200 may be configured to capture an image of a predetermined area including the golf mat 13 on which a golf ball 1 is placed.

The first camera 100 and the second camera 200 disposed as described above acquire images of the hit golf ball 1 respectively and transmit them to the client, the simulator analyzes the image acquired by each camera to calculate position information on the 3D space for the golf ball 1, and the client may calculate motion parameters according to the movement of the hit golf ball 1 based on the calculated position information. Accordingly, a simulation image of the trajectory of the ball based on the calculated motion parameters of the golf ball can be performed on the image of the golf course.

2D coordinate information of the golf ball and the golf club is calculated from a portion corresponding to the golf ball and the golf club extracted from the acquisition image of the first camera, another 2D coordinate information of the golf ball and the golf club is calculated from a portion corresponding to the golf ball and the golf club extracted from the acquisition image of the second camera, and 3D position information for the golf ball and the golf club using the 2D coordinates information can be calculated. A sensing processor 300 is an element that performs a function of calculating the above-mentioned 3D position information for the golf ball and the golf club.

As shown in FIG. 2, the sensing device according to an embodiment of the present invention includes a first camera 100, a second camera 200, and a sensing processor 300 connected thereto to receive and process data from each camera. The sensing processor 300 may be configured to include an image processor 310 and a position calculator 320.

The sensing processor 300 may analyze the image acquired by the first camera 100 to calculate first position information for calculating the impact position from the club trajectory on the image. (The first camera acquires images of multiple frames at a predetermined speed, and the images of multiple frames acquired by the first camera are defined as "first images"). In addition, the sensing processor 300 may analyze the image acquired by the second camera 200 to calculate second position information as another information for calculating the impact position from the club trajectory on the image. (The second camera acquires images of multiple frames at a predetermined speed, and the images of multiple frames acquired by the second camera are defined as "second images").

And, the sensing processor 300 is configured to calculate the impact position where the clubhead hits the golf ball during the golf swing using the first position calculated from the first images of the first camera and the second position calculated from the second images of the second camera as stated above.

The image processor 310 analyzes the first image, which is an image acquired by the first camera 100, and finds the position of the golf ball portion on the image. (The portion corresponding to the golf ball detected in the first image is referred to as the "first ball"). The image processor analyzes the movement of the golf club on the first image to calculate the trajectory of the golf club on the first image. (The trajectory of the golf club head detected on the first image is referred to as a "first club trajectory").

In addition, the image processor 310 analyzes the second image, which is an image acquired by the second camera 200, and finds the position of the golf ball portion on the image. (The portion corresponding to the golf ball detected in the second image is referred to as a "second ball"). The image processor analyzes the movement of the golf club on the second image to calculate the trajectory of the golf club on the second image. (The trajectory of the golf club head detected in the second image is referred to as a "second club trajectory").

The position calculator 320 calculates impact position information on the head-face of a pre-prepared golf club or on the head-face detected by image analysis using the positions information of the first ball, the first club trajectory, the second ball and the second club trajectory calculated by the image processor 310.

That is, the position calculator 320 may be configured to calculate the impact position specified by the first position and the second position, wherein the first position information may be calculated using the position of the first ball and the first club trajectory, and the second position information may be calculated using the position of the second ball and the second club trajectory.

More detailed descriptions with respect to the calculation of the impact position by each of the cameras and the sensing processor as described above will be described below.

Figure 3:
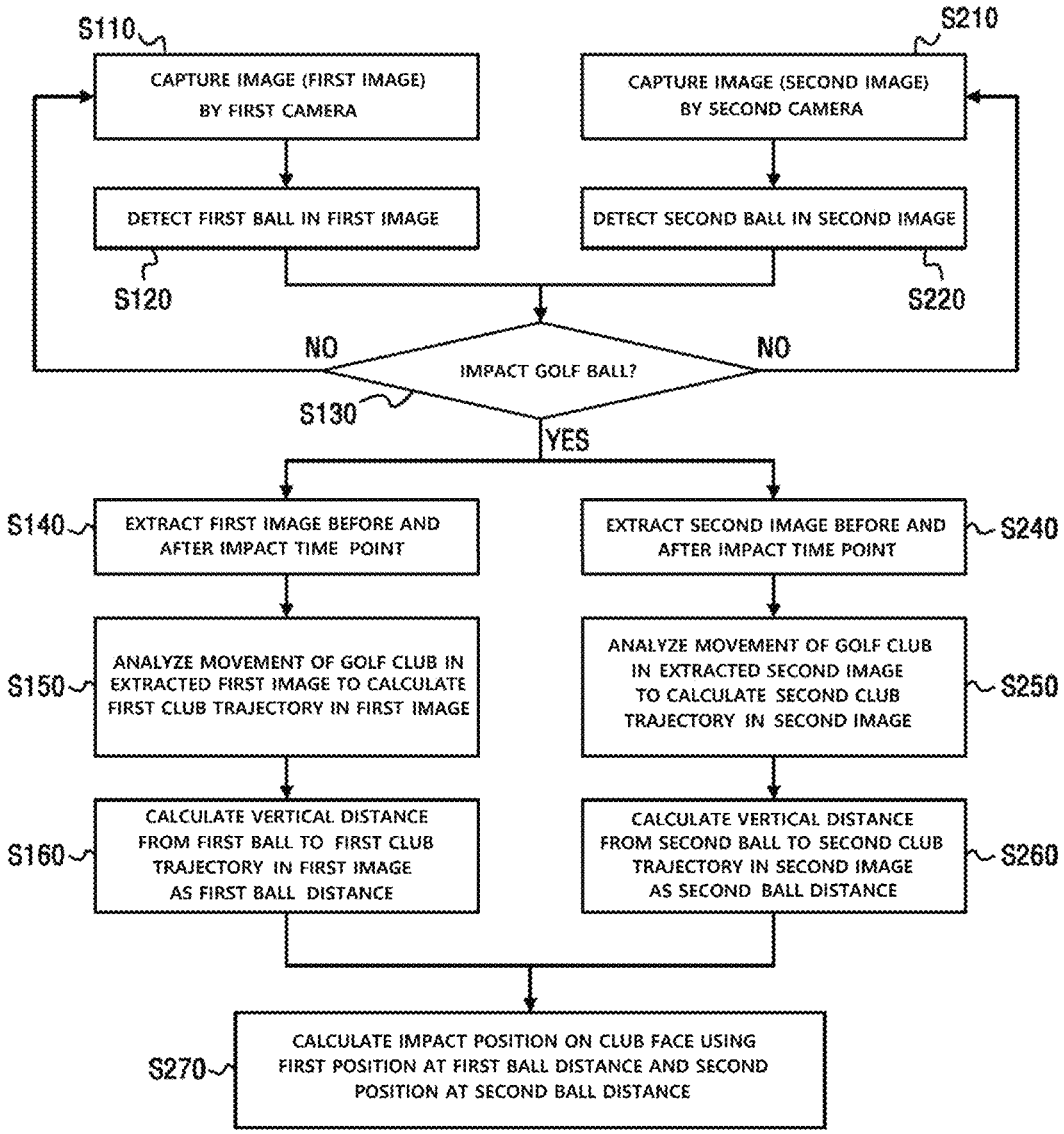
FIG. 3 is a flow chart showing a method for sensing an impact position on club head using the sensing device according to an embodiment of the present invention.

Meanwhile, the method of sensing the impact position of the club head using the sensing device according to an embodiment of the present invention will be described with reference to the flowchart shown in FIG. 3.

The sensing device according to an embodiment of the present invention includes a first camera and a second camera that are linked in a stereoscopic manner as described above, and each of the cameras acquires an image of a subject captured in the field of view.

That is, a first image which is an image by the first camera is acquired (S110), and a second image which is an image by the second camera is acquired (S210).

The first ball is detected in the first image (S120), and the second ball is detected in the second image (S220).

The sensing processor consecutively detects the first ball in the first image or the second ball in the second image and determines whether the golf ball is hit by the golf club, that is, whether the golf ball is impacted (S130).

When the impact on the golf ball is detected, the sensing processor extracts a predetermined number of images before the impact time point and a predetermined number of images after the impact time point from among the images of the first image acquired by the first camera (S140).

That is, the sensing processor detects the golf club from the first image and analyzes the movement thereof to calculate the first club trajectory on the first image (S150).

The sensing processor may detect specific point of the golf club in each of the frames of the first image, and calculate the first club trajectory by connecting the specific points detected on the frames of the first image. The specific point may be, for example, a first reference point which is a point located at the toe-side end of the club head of the golf club, or the point located at the hosel corresponding to the boundary between the shaft and the head of the golf club.

Then, the sensing processor calculates a vertical distance from the center point of the first ball detected in the first image to the calculated first club trajectory (S160). Wherein, it is preferable that the first ball is an object corresponding to a golf ball detected when the golf ball is in a stopped state. The vertical distance from the center point of the first ball to the calculated first club trajectory is referred to as a "first ball distance".

Meanwhile, when an impact on the golf ball is detected, a process for deriving an analysis result for the first image as well as an analysis result for the second image is performed.

The sensing processor extracts a predetermined number of images before the impact time point and a predetermined number of images after the impact time point from among the images of the second image acquired by the second camera (S240).

That is, the sensing processor detects the golf club from the second image and analyzes the movement thereof to calculate the second club trajectory on the second image (S250).

The sensing processor may detect specific point of the golf club in each of the frames of the second image, and calculate the second club trajectory by connecting the specific points detected on the frames of the second image. The specific point may be, for example, a point located at the toe-side end of the club head of the golf club, or the point located at the hosel corresponding to the boundary between the shaft and the head of the golf club.

However, the point located at the toe-side end of the club-head, which is the reference point for the second club trajectory in the second image, is not the same point as the point located at the toe-side end of the clubhead, which is the reference point for the first club trajectory in the first image.

The point located at the toe-side end of the clubhead, which is the reference point for the first club trajectory in the first image, is called the first reference point, and the point located at the toe-side end of the clubhead of the golf club, which is the reference point for the second club trajectory in the second image. The first reference point and the second reference point may be the same point on the actual clubhead or points at different positions.

However, when the first reference point and the second reference point are respectively located in the hosel of the golf club, they are the same point on the actual golf club.

The sensing processor calculates a vertical distance from the center point of the second ball detected in the second image to the calculated second club trajectory (S260). Wherein, it is preferable that the second ball is an object corresponding to a golf ball detected when the golf ball is in a stopped state. The vertical distance from the center point of the second ball to the calculated second club trajectory is referred to as a "second ball distance".

The first ball distance and the second ball distance are calculated, respectively, as described, the sensing processor calculates the impact position specified by the first position and the second position when the position of the first ball distance away from the reference position on the club face of the golf club is the first position and the position of the second ball distance away from the reference position on the club face of the golf club is the second position (S270).

An example of calculating the impact position as described above will be described with reference to FIGS. 4 to 7.

Figure 4:
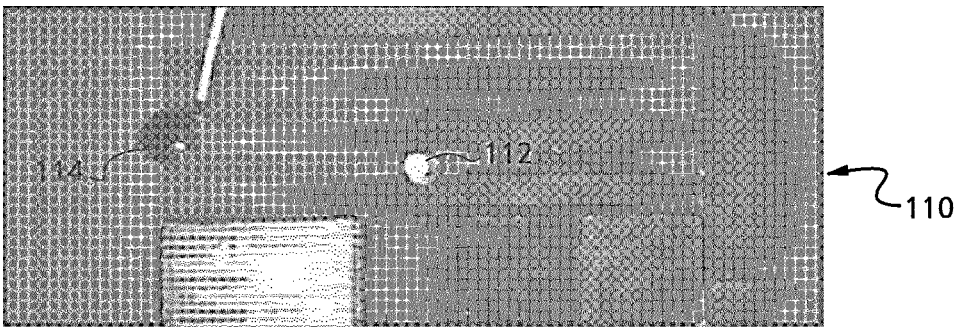
FIG. 4 shows a first image acquired by a first camera and a second image acquired by a second camera of the sensing device according to an embodiment of the present invention.
Figure 4:
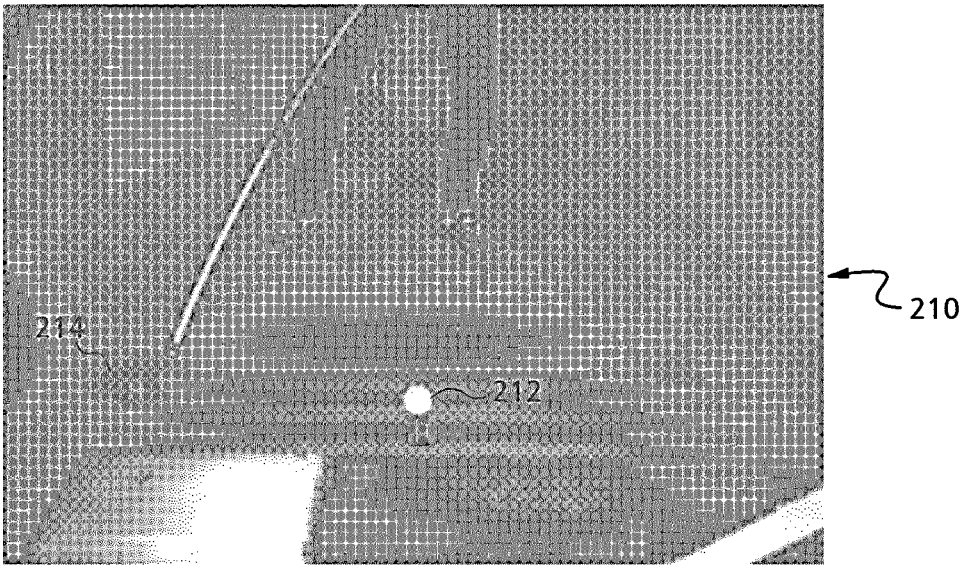

FIG. 4(*a*) shows the first image acquired by the first camera and FIG. 4(*b*) shows the second image acquired by the second camera of the sensing device according to an embodiment of the present invention.

The first image 110 shown in FIG. 4(*a*) shows the first ball 112 and the clubhead 114 vertically downward from the ceiling, and the second image 210 shown in FIG. 4(*b*) shows the second ball 212 and the clubhead 214 obliquely downward from the side of the golf mat.

In FIG. 4(*a*) and FIG. 4(*b*), the ball and the clubhead can be identified from a human perspective, but since the computer does not know which a ball is and which a clubhead is from a computer's perspective, the ball may be detected by an algorithm for detecting a golf ball in an image, and the golf club may be detected by an algorithm for detecting a golf club.

Figure 5:
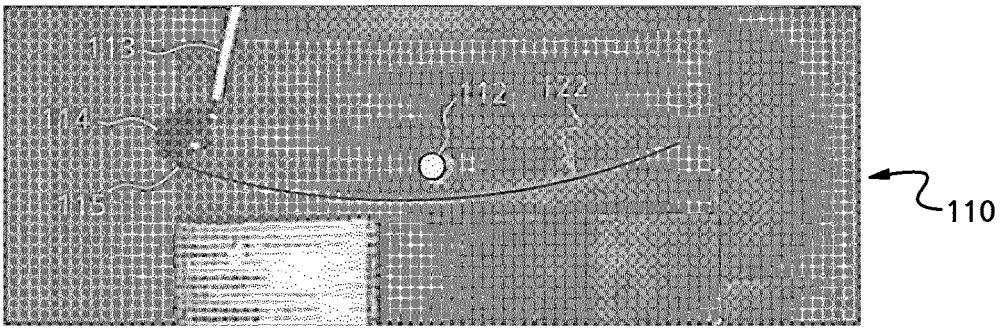
FIG. 5 shows the results of detecting the first and second balls and the first and the second club trajectories in the first and the second images shown in FIG. 4.
Figure 5:
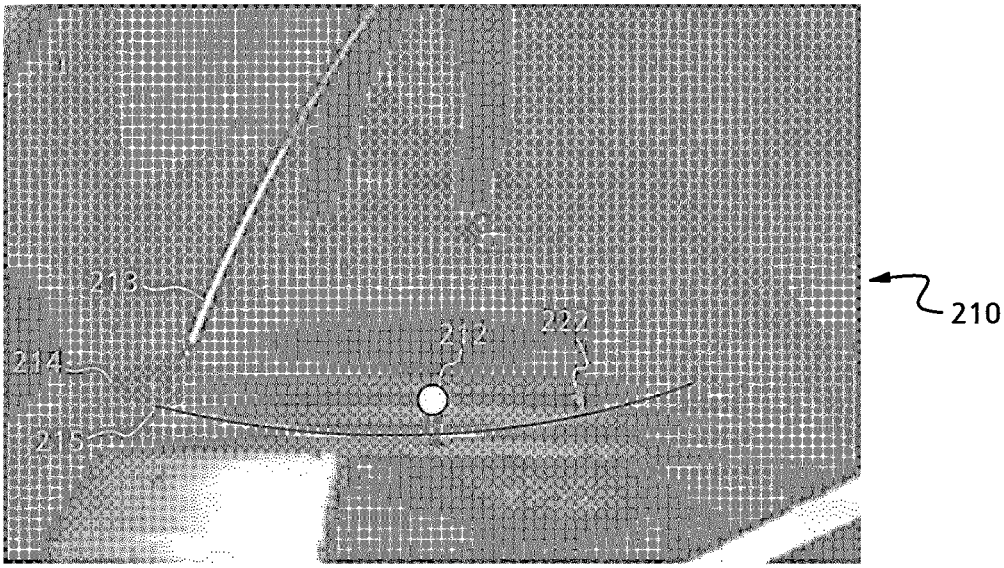

FIG. 5(*a*) shows the results of detecting the first ball 112 and the first club trajectory 122 in the first image 110 shown in FIG. 4(*a*), and FIG. 5(*b*) shows the results of detecting the second ball 212 and the second club trajectory 222 in the second image 210 shown in FIG. 4(*b*), respectively.

The first club trajectory 122 shown in FIG. 5(*a*) shows a result detected when the point of the toe-side end of the club head 114 of the golf club on the first image 110 is set as the first reference point 115. The second club trajectory 222 shown in FIG. 5(*b*) shows the result detected when the point of the toe-side end of the club head 214 of the golf club on the second image 210 is the second reference point 215.

Wherein, the first reference point 115 and the second reference point 215 may be points at different positions as shown in figures.

The first reference point 115 may be a point where an optical axis in the field of view captured by the first camera meets the toe-side end of the clubhead, and the second reference point 215 may be a point where the optical axis of the field of view captured by the second camera meets the toe-side end of the clubhead.

For example, when Hough Transform is performed on the first image 110, the shaft 113 of the golf club is converted into a straight line, and the point where the end point of the converted straight line meets the optical axis can be obtained as the first reference point 115. The first reference point is obtained from each of the plurality of frames of the first image as described above, and the first club trajectory 122 as shown in FIG. 5(*a*) may be obtained by connecting the obtained first reference points.

In addition, when Hough Transform is performed on the second image 210, the shaft 213 of the golf club is converted into a straight line, and the point where the end point of the converted straight line meets the optical axis can be obtained as the second reference point 215. The second reference point is obtained from each of the plurality of frames of the second image as described above, and the second club trajectory 222 as shown in FIG. 5(*b*) may be obtained by connecting the second reference points.

As described above, after obtaining the first ball 112 and the first club trajectory 122 in the first image 110, and obtaining the second ball 212 and the second club trajectory 222 in the second image 210, the impact position may be calculated using the first ball, the first club trajectory, the second ball, and the second club trajectory, which will be described with reference to FIGS. 6 and 7.

Figure 6:
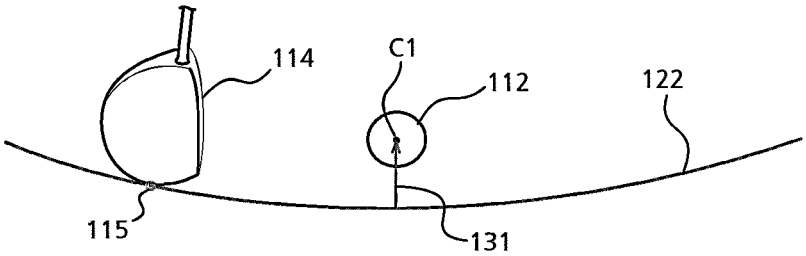
FIGS. 6 and 7 show the method for calculating an impact position using the positions of the ball and the club trajectory shown in FIG. 5.
Figure 6:
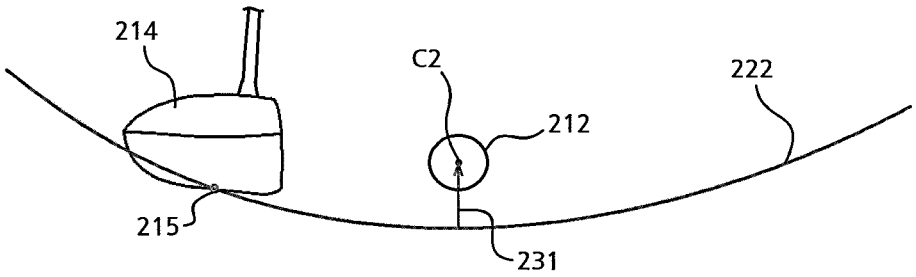

FIG. 6(*a*) shows a more simplified relationship between objects shown in FIG. 5(*a*), and FIG. 6(*b*) shows a more simplified relationship between objects shown in FIG. 5(*b*).

Referring to FIG. 6(*a*), a vertical distance from the center point C1 of the first ball 112 to the first club trajectory 122 may be obtained, which is referred to as the first ball distance 131.

The first club trajectory 122 is in the form of an arc, and when the shortest distance between the center point C1 of the first ball and the first club trajectory 122 of the arc is obtained, the first ball distance 131, that is the vertical distance from the center point C1 of the first ball to the first club trajectory 122 can be calculated.

Meanwhile, in FIG. 6(*b*), a vertical distance from the center point C2 of the second ball 212 to the second club trajectory 222 may be obtained, which is referred to as the second ball distance 231.

The second club trajectory 222 is in the form of an arc, and when the shortest distance between the center point C2 of the second ball and the second club trajectory 222 of the arc is obtained, the second ball distance 231, that is the vertical distance from the center point C2 of the second ball to the second club trajectory 222 can be calculated.

The impact position may be calculated by using the first ball distance 131 and the second ball distance 231.

Figure 7:
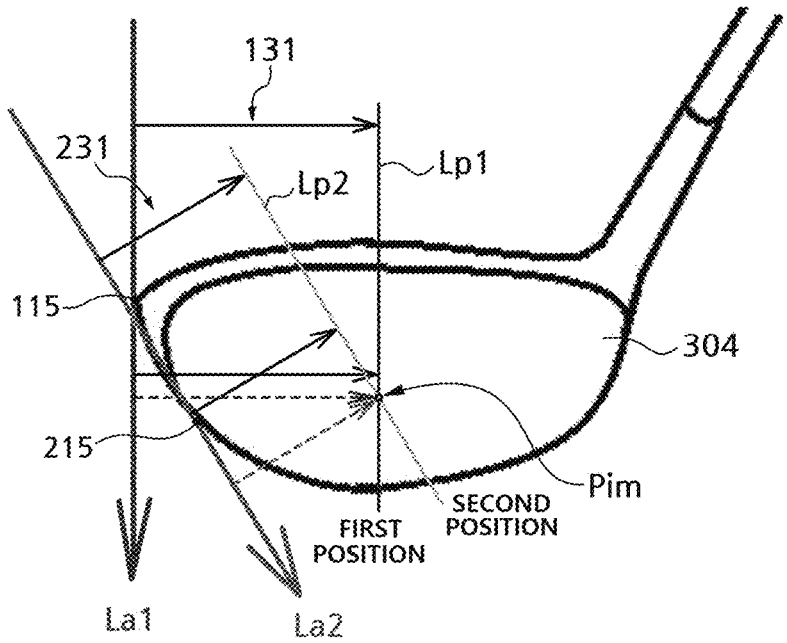

FIG. 7 shows calculating the impact position on the club face using the first ball distance 131 and the second ball distance 231.

The club face 304 shown in FIG. 7 may be provided according to the size and shape of the club head's face detected by the sensing processor through the first image and/or the second image, or provided by being determined through data on characteristics of each type of golf club pre-stored and calibration information of the first camera and the second camera.

Regarding the detection of club face from images, for example, since the face portion of the club head of a golf club has a large reflection on light, it can be easily detected by specifying the face portion in the first and second images, and the size and shape of the face can be calculated from the detected result and provided to the club face 304 as shown in FIG. 7.

In addition, information on the size and shape of each type of golf club, such as drivers, wood, and various irons, is pre-stored, and the type of golf club used by the user when taking golf shots is recognized using other sensor, and by extracting the face size and shape information on the recognized golf club, it may be provided as the club face 304 as shown in FIG. 7.

The present invention does not focus on a method of obtaining a club face of a golf club. Assuming that the size and shape of the club face may be obtained by any conventional method or any method to be developed in the future, the present invention focuses on a method of accurately obtaining an impact position on the club face obtained by any method.

Therefore, a detailed description of a method of obtaining a club face will be omitted.

In FIGS. 5 and 6, it has been described that the point where the optical axis of the first camera and the optical axis of the second camera meet with the toe-side end of the golf club head, respectively, becomes a reference point for calculating the club trajectory.

Referring to FIG. 7, the optical axis of the first camera passing through the first reference point 115 on the club head is referred to as "La1", and the optical axis of the second camera passing through the second reference point 215 on the club head is referred to as "La2". And, La1 is referred to as a "first optical axis" and La2 is referred to as a "second optical axis".

As described in FIG. 6, the first ball distance 131 is obtained as a vertical distance from the center point of the first ball to the first club trajectory in the first image, and the second ball distance 231 is obtained as a vertical distance from the center point of the second ball to the second club trajectory in the second image.

In FIG. 7, the first ball distance 131 is a distance from the first optical axis La1, and the second ball distance 231 is a distance from the second optical axis La2.

Wherein the direction of the first ball distance is the direction from the first club trajectory to the first ball, and the direction of the second ball distance is the direction from the second club trajectory to the second ball.

The first position for calculating the impact position is located on the first ball distance 131 from the first optical axis La1, and the second position is located on the second ball distance 231 from the second optical axis La2.

As shown in FIG. 7, when a line connecting points on the first ball distance 131 from the first optical axis La1 is referred to as "Lp1", and a line connecting points on the second ball distance 231 from the second optical axis La2 is referred to as "Lp2", the point where the Lp1 line (where the first position exists) and the Lp2 line (where the second position exists) intersect becomes the 'Impact position Pim' where the first position and the second position meet each other.

As described above, when the first ball and the first club trajectory are detected through the first image and the first ball distance is calculated from the first ball and the first club trajectory, and the second ball and the second club trajectory are detected through the second image and the second ball distance is calculated from the second ball and the second club trajectory, an impact position where the first position corresponding to the first ball distance and the second position corresponding to the second ball distance meet each other may be calculated in a manner shown in FIG. 7.

In FIGS. 4 to 7, an example of a method of calculating an impact position is shown when the reference point of the club trajectory is used as the point of the toe-side end of the club head. However, as mentioned above, there is also a method of calculating the club trajectory based on the position of the hosel on the golf club and calculating the impact position from it, which will be described with reference to FIGS. 8 to 10.

Figure 8:
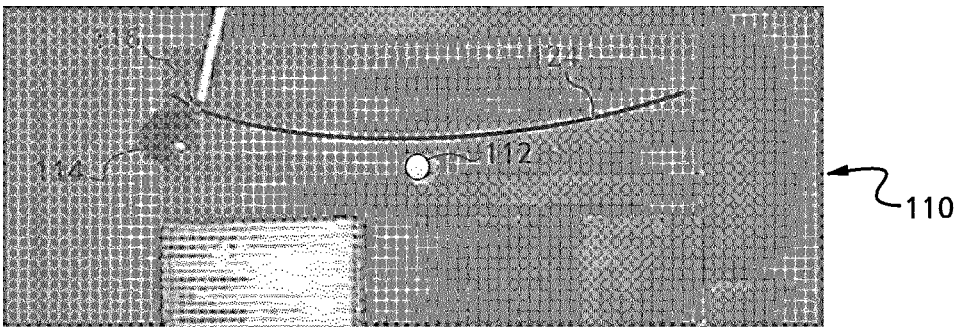
FIG. 8 shows another example for calculating the club trajectory by the sensing device according to an embodiment of the present invention using the images shown in FIG. 4.
Figure 8:
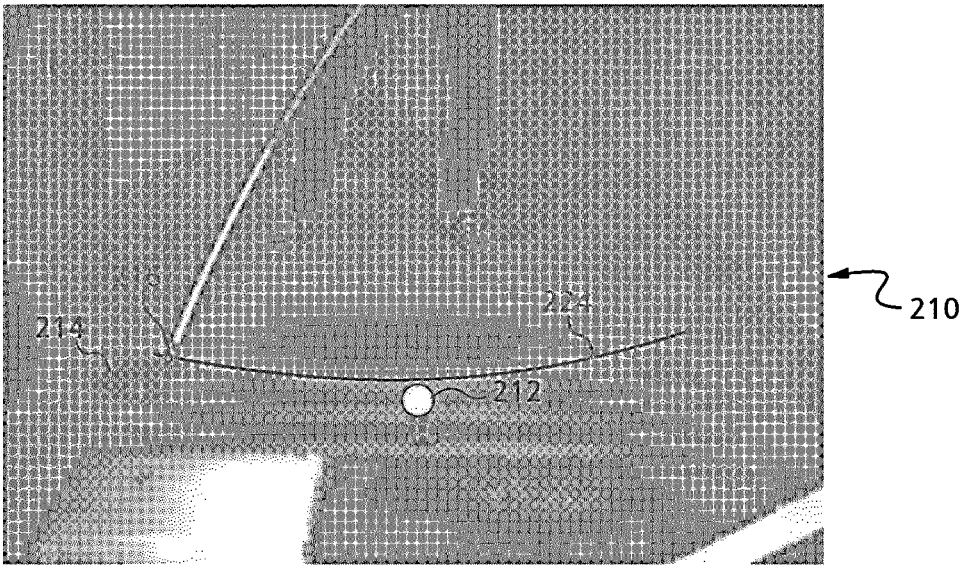

FIG. 8(*a*) shows the results of detecting the first ball 112 and the first club trajectory 124 calculated based on the hosel position 116 of the golf club in the first image 110 shown in FIG. 4(*a*). In addition, FIG. 8(*b*) shows the results of detecting the second club trajectory 224 calculated based on the second ball 212 and the hosel position 216 in the second image 210 shown in FIG. 4(*b*).

The first club trajectory 124 shown in FIG. 8(*a*) shows the result of detecting the point of the hosel position of the golf club on the first image 110 as the first reference point 116. The second club trajectory 224 shown in FIG. 8(*b*) shows the result detected using the point of the hosel position of the golf club on the second image 210 as the second reference point 216.

The method of detecting the position of the hosel through the analysis of the image of the golf club is already a known technology, and is described in detail in Korean Patent Registration No. 10-1862145 registered and patented by this applicant.

As described above, after obtaining the first ball 112 and the first club trajectory 124 in the first image 110, and obtaining the second ball 212 and the second club trajectory 224 in the second image 210, an impact position may be calculated using the first ball, the first club trajectory, the second ball and the second club trajectory, which will be described with reference to FIGS. 9 and 10.

Figure 9:
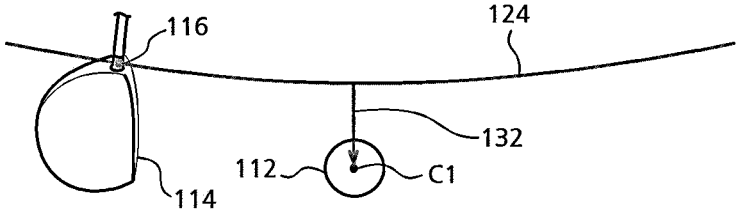
FIGS. 9 and 10 show the method for calculating an impact position using the positions of the ball and the club trajectory shown in FIG. 8.
Figure 9:
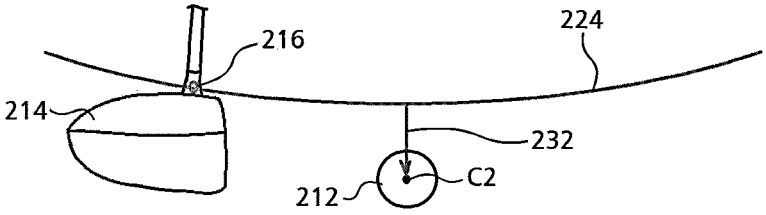

FIG. 9(*a*) shows a more simplified relationship between objects shown in FIG. 8(*a*), and FIG. 9(*b*) shows a more simplified relationship between objects shown in FIG. 8(*b*).

Referring to FIG. 9(*a*), a vertical distance from the center point C1 of the first ball 112 to the first club trajectory 124 may be obtained, which is referred to as the first ball distance 132.

The first club trajectory 124 is in the form of an arc, and when the shortest distance between the center point C1 of the first ball and the first club trajectory 124 of the arc is obtained, the first ball distance 132, that is the vertical distance from the center point C1 of the first ball to the first club trajectory 124 can be calculated.

Meanwhile, in FIG. 9(*b*), the vertical distance from the center point C2 of the second ball 212 to the second club trajectory 224 may be obtained, which is referred to as the second ball distance 232.

The second club trajectory 224 is in the form of an arc, and when the shortest distance between the center point C2 of the second ball and the second club trajectory 224 of the arc is obtained, the second ball distance 232, that is the vertical distance from the center point C2 of the second ball to the second club trajectory 224 can be calculated.

The impact position may be calculated by using the first ball distance 132 and the second ball distance 232.

Figure 10:
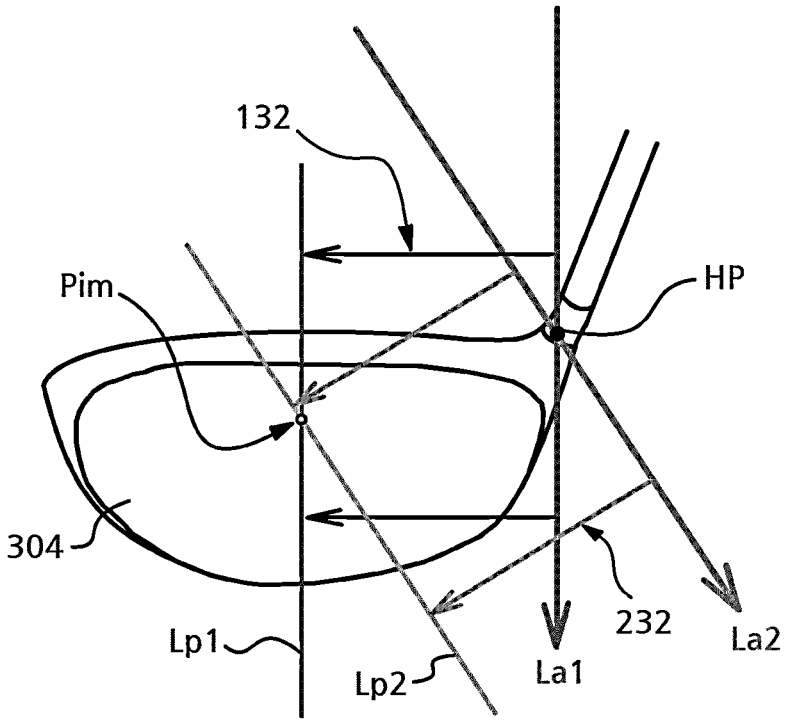

FIG. 10 shows calculating the impact position on the club face using the first ball distance 132 and the second ball distance 232.

The club face 304 shown in FIG. 10 is the same as described above with reference to FIG. 7, and thus a description thereof will be omitted.

Referring to FIG. 10, the optical axis of the first camera passing through the first reference point 116 on the club head is referred to as "La1", and the optical axis of the second camera passing through the second reference point 216 on the club head is referred to as "La2". And, La1 is referred to as a "first optical axis" and La2 is referred to as a "second optical axis".

As described in FIG. 9, the first ball distance 132 is obtained as a vertical distance from the center point of the first ball to the first club trajectory in the first image, and the second ball distance 232 is obtained as a vertical distance from the center point of the second ball to the second club trajectory in the second image.

In FIG. 10, the first ball distance 132 is a distance from the first optical axis La1, and the second ball distance 232 is a distance from the second optical axis La2.

Wherein the direction of the first ball distance is the direction from the first club trajectory to the first ball, and the direction of the second ball distance is the direction from the second club trajectory to the second ball.

The first position for calculating the impact position is located on the first ball distance 132 from the first optical axis La1, and the second position is located on the second ball distance 232 from the second optical axis La2.

As shown in FIG. 10, when a line connecting points on the first ball distance 132 from the first optical axis La1 is referred to as "Lp1", and a line connecting points on the second ball distance 232 from the second optical axis La2 is referred to as "Lp2", the point where the Lp1 line (where the first position exists) and the Lp2 line (where the second position exists) intersect becomes the 'Impact position Pim' where the first position and the second position meet each other.

As described above, when the first ball and the first club trajectory are detected through the first image and the first ball distance is calculated from the first ball and the first club trajectory, and the second ball and the second club trajectory are detected through the second image and the second ball distance is calculated from the second ball and the second club trajectory, an impact position where the first position corresponding to the first ball distance and the second position corresponding to the second ball distance meet each other may be calculated in a manner shown in FIG. 10.

As described above, the device for sensing golf swing and a method for sensing an impact position on club head using the same according to the present invention has an advantageous effect that it is possible to accurately calculate the position where the golf ball is impacted on the head-face of the golf club when hitting the golf ball using two cameras operated in a stereoscopic interworking with each other in the sensing device.

INDUSTRIAL APPLICABILITY

A device for sensing golf swing and method for sensing impact position on club head using the same according to the present invention are applicable to industries related to a golf analysis and industries related to a virtual golf simulation system based on an analysis of the movement of a golf club during golf swing.

The invention claimed is:

1. A sensing device for a screen golf system, comprising:

a first camera and a second camera operated in a stereoscopic manner, wherein the first camera is installed at a first location which is on a ceiling of a booth forming a space for screen golf and above a head of a user and configured to acquire a first image of a field of view including a golf ball and a golf club, and the second camera is installed at a second location which is on a wall side of the booth and different from the first location and configured to acquire a second image of a field of view including the golf ball and the golf club, wherein an angle of view of the first camera and an angle of view of the second camera overlap each other; and a sensing processor configured to analyze the first image acquired by the first camera to calculate information on a first position from a first club trajectory on the first image, and analyze the second image acquired by the second camera to calculate information on a second position from a second club trajectory on the second image, wherein the sensing processor calculates an impact position where a club head of the golf club hits the golf ball during a golf swing using the first position and the second position, wherein the sensing processor includes:

an image processor configured to:

analyze the first image to detect a position of a first ball which is a portion corresponding to the golf ball in the first image, perform a Hough Transform on the first image such that a shaft of the golf club in the first image is converted into a first straight line, obtain, from each of a plurality of frames of the first image, a first reference point which is a point where an end point of the first straight line meets an optical axis of the first camera, and analyze movement of the golf club on the first image to calculate the first club trajectory by connecting the first reference points obtained from the plurality of frames of the first image; and analyze the second image to detect a position of a second ball which is a portion corresponding to the golf ball in the second image, perform a Hough Transform on the second image such that the shaft of the golf club in the second image is converted into a second straight line, obtain, from each of a plurality of frames of the second image, a second reference point which is a point where an end point of the second straight line meets an optical axis of the second camera, and analyze movement of the golf club on the second image to calculate the second club trajectory by connecting the second reference points obtained from the plurality of frames of the second image; and a position calculator configured to calculate the impact position using the position of the first ball, the first club trajectory, the position of the second ball, and the second club trajectory, wherein the position calculator is configured to:

calculate a vertical distance from a center point of the first ball to the first club trajectory on the first image as a first ball distance;

calculate a vertical distance from a center point of the second ball to the second club trajectory on the second image as a second ball distance; and calculate a point, where the first position located at the first ball distance in a direction perpendicular to the optical axis of the first camera and the second position located at the second ball distance in a direction perpendicular to the optical axis of the second camera meet each other, as the impact position, wherein the first camera and the second camera are further configured to acquire images of the golf ball hit by the golf club and to transmit the acquired images of the golf ball hit by the golf club to a client of the screen golf system, wherein the sensing processor is further configured to calculate position information on a three-dimensional space for the golf ball hit by the golf club and to transmit sensing data comprising the calculated position information and the calculated impact position to the client, wherein the client is configured to calculate motion parameters according to movement of the golf ball hit by the golf club based on the calculated position information, and wherein an image output device of the screen golf system is configured to receive image information from the client and to output, on a screen installed in front of the user in the booth, a simulation image in which a trajectory of the golf ball hit by the golf club based on the calculated motion parameters is implemented on an image of a golf course.

2. The sensing device according to claim 1, wherein the image processor is configured to calculate the first club trajectory by calculating a trajectory in which the first reference point which is a point where a toe-side end of the club head detected on the first image meets the optical axis of the first camera moves, and calculate the second club trajectory by calculating a trajectory in which the second reference point which is a point where a toe-side end of the club head detected on the second image meets the optical axis of the second camera moves.

3. The sensing device according to claim 2, wherein the position calculator is configured to calculate a point where the first position at the first ball distance in the direction perpendicular to the optical axis of the first camera in contact with the toe-side end of the club head detected on the first image and the second position at the second ball distance in the direction perpendicular to the optical axis of the second camera in contact with the toe-side end of the club head detected on the second image meet each other as the impact position.

4. The sensing device according to claim 1, wherein the image processor is configured to calculate the first club trajectory by calculating a trajectory in which the first reference point which is a point corresponding to a hosel of the golf club detected on the first image moves, and calculate the second club trajectory by calculating a trajectory in which the second reference point which is a point corresponding to the hosel of the golf club detected on the second image moves.

5. The sensing device according to claim 4, wherein the position calculator is configured to calculate a point where the first position at the first ball distance in the direction perpendicular to the optical axis of the first camera passing through a position of the hosel of the golf club and the second position at the second ball distance in the direction perpendicular to the optical axis of the second camera passing through the position of the hosel of the golf club meet each other as the impact position.

6. The sensing device according to claim 1, wherein the first position is a position located the first ball distance away from a reference position on a club face of the golf club, and the second position is a position located the second ball distance away from the reference position on the club face of the golf club.

* * * * *